US010273990B2

(12) United States Patent
Campbell et al.

(10) Patent No.: US 10,273,990 B2
(45) Date of Patent: Apr. 30, 2019

(54) FIXED WOBBLER FOR HYDRAULIC UNIT

(71) Applicant: Hamilton Sundstrand Corporation, Charlotte, NC (US)

(72) Inventors: Kris H. Campbell, Poplar Grove, IL (US); Glenn C. Lemmers, Jr., Loves Park, IL (US); Doren C. Smith, Rockford, IL (US); Jonathan C. Dell, Carpentersville, IL (US); Jong-Yeong Yung, Rockford, IL (US); Ted A. Martin, Byron, IL (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 984 days.

(21) Appl. No.: 14/596,439

(22) Filed: Jan. 14, 2015

(65) Prior Publication Data

US 2016/0201698 A1 Jul. 14, 2016

(51) Int. Cl.
*F04B 1/20* (2006.01)
*F15B 15/14* (2006.01)

(52) U.S. Cl.
CPC ..... *F15B 15/1404* (2013.01); *F04B 1/2078* (2013.01)

(58) Field of Classification Search
CPC ..... F04B 1/2078; F04B 1/146; F04B 1/148; F04B 1/2085; F15B 15/1404
See application file for complete search history.

(56) References Cited

U.S. PATENT DOCUMENTS 5,687,631 A * 11/1997 Kim ..... F04B 1/324 417/222.1
6,572,342 B2 * 6/2003 Ahn ..... F04B 27/1054 29/888.02
2001/0054352 A1 * 12/2001 Sugiura ..... F04B 27/0886 92/61
2005/0025629 A1 * 2/2005 Ford ..... F04B 47/02 417/53
2011/0314963 A1 12/2011 Poisson

FOREIGN PATENT DOCUMENTS

DE 584665 C 9/1933
DE 2253419 A1 5/1974
DE 102008060491 A1 6/2010

OTHER PUBLICATIONS

European Search Report for Application No. 16151327.0-1608 dated Jun. 15, 2016; 7 pages.

* cited by examiner

*Primary Examiner* — Michael Leslie
*Assistant Examiner* — Abiy Teka
(74) *Attorney, Agent, or Firm* — Cantor Colburn LLP

(57) ABSTRACT

A fixed wobbler of a hydraulic unit includes a body having a first end and an opposite second end, the first end defining a first surface, and the second end defining a second surface oriented at an angle relative to the first surface, the body having an outer diameter and an inner wall defining an inner diameter, wherein the outer diameter is approximately 2.1655+0.0000−0.0007 inches (5.5004+0.000−0.0018 cm), and wherein the inner diameter is approximately 1.043±0.003 inches (2.6492±0.0076 cm).

14 Claims, 6 Drawing Sheets

FIXED WOBBLER FOR HYDRAULIC UNIT

BACKGROUND OF THE INVENTION

Exemplary embodiments of this invention generally relate to an integrated drive generator, and more particularly, to a fixed wobbler of a hydraulic unit of an integrated drive generator.

Aircrafts currently rely on electrical, pneumatic, and hydraulic systems for secondary power. A typical electrical system utilizes an integrated drive generator (IDG) coupled to each engine to provide a fixed frequency power to the distribution system and loads. One type of IDG includes a generator, a hydraulic unit, and a differential assembly arranged in a common housing. The differential assembly is operably coupled to a gas turbine engine via an input shaft. The rotational speed of the input shaft varies during the operation of the gas turbine engine. The hydraulic unit cooperates with the differential assembly to provide a constant speed to the generator throughout engine operation.

Due to packaging constraints, components of the hydraulic unit, such as variable and fixed wobblers must be redesigned.

BRIEF DESCRIPTION OF THE INVENTION

According to one embodiment of the invention a fixed wobbler of a hydraulic unit includes a body having a first end and an opposite second end, the first end defining a first surface, and the second end defining a second surface oriented at an angle relative to the first surface, the body having an outer diameter and an inner wall defining an inner diameter, wherein the outer diameter is approximately 2.1655+0.0000−0.0007 inches (5.5004+0.000−0.0018 cm), and wherein the inner diameter is approximately 1.043±0.003 inches (2.6492±0.0076 cm).

In addition to one or more of the features described above, or as an alternative, further embodiments may include wherein the body further comprises a cutout formed in the first surface about at least a portion of the inner wall; where the cutout defines an inner shoulder having a radius of approximately 0.156±0.015 inches (0.3962±0.1381 cm); wherein the angle is between approximately 12.75° and approximately 16.75°; wherein the angle is approximately 14.75°; wherein the body further comprises a locking feature formed in the body outer diameter, the locking feature defined by an inner rear wall and a pair of side walls; wherein the locking feature has a length of approximately 0.503±0.010 inches (1.2777±0.0254 cm); wherein a distance between the side walls is approximately 0.250+0.005−0.000 inches (0.635+0.0127−0.000 cm); wherein a distance from the inner rear wall to a centerpoint of the outer diameter is approximately 0.982+0.000−0.010 inches (2.4943+0.000−0.0254); wherein the second surface comprises a friction-reducing coating; wherein the friction-reducing coating is between approximately 3 microns and approximately 5 microns; wherein the friction-reducing coating is an Amorphous Diamond-like Carbon Coating; wherein the inner wall includes a corner break that is less than or equal to approximately 0.005 inches (0.0127 cm); and wherein the body first end includes a first corner break disposed adjacent to a second corner break, the first corner break oriented relative to the first surface at a second angle, wherein the second angle is approximately 40°+0.00°−0.25°.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
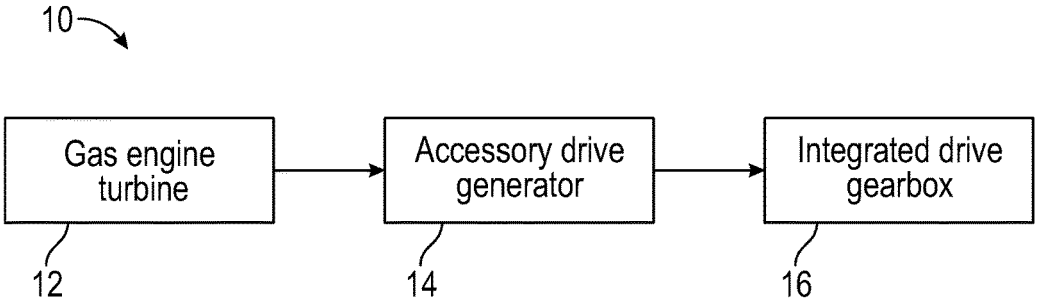
FIG. 1 is a schematic diagram of a generator system of an aircraft.

Referring now to FIG. 1, an example of a generator system 10 is schematically illustrated. The system 10 includes a gas turbine engine 12 that provides rotational drive to an integrated drive generator (IDG) 16 through an accessory drive gearbox 14 mounted on the gas turbine engine 12. The accessory drive gearbox is coupled to a spool of the engine 12, and the speed of the spool varies throughout the entire engine operation.

Figure 2:
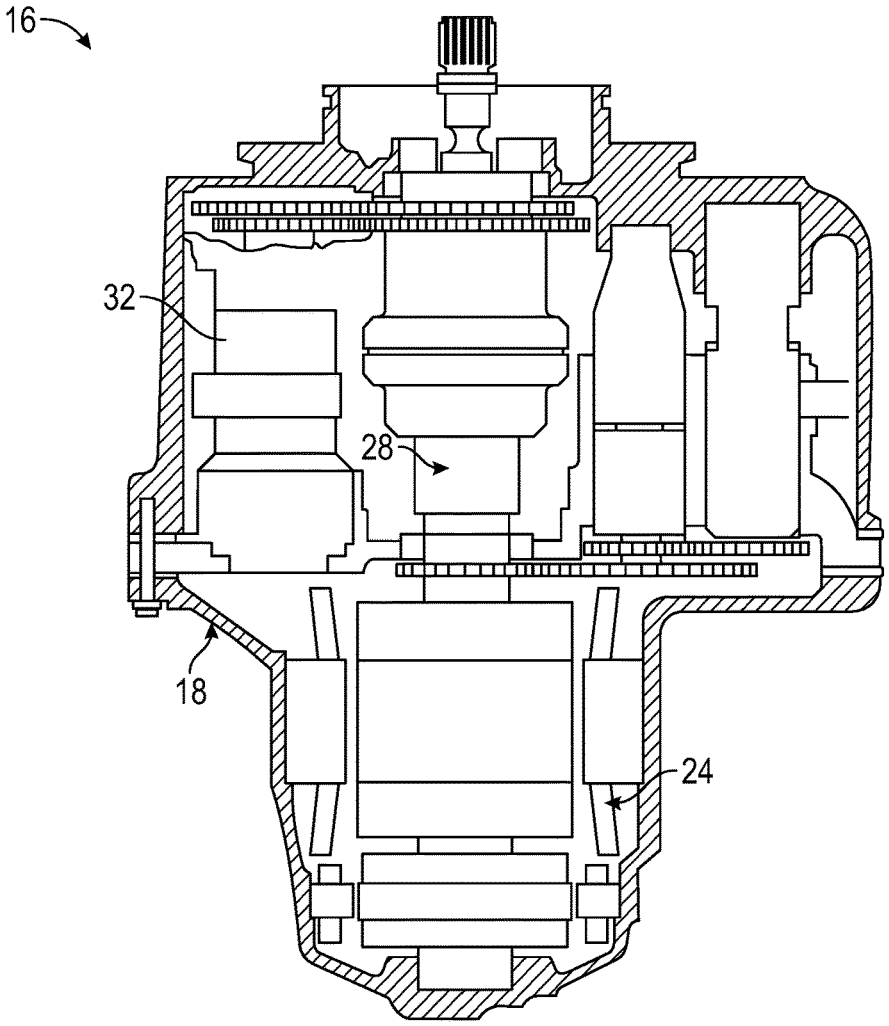
FIG. 2 is a cross-sectional schematic view of an example of an integrated drive generator (IDG)

An example of an IDG 16 including a housing 18 is shown in FIG. 2. In the illustrated embodiment, the IDG 16 includes an input shaft configured to receive rotational drive from the accessory drive gearbox 14. The rotational speed of the input shaft varies depending upon the operation of the engine. To this end, a hydraulic unit 32 cooperates with the differential assembly 28 to convert the variable rotational speed from the input shaft to a fixed rotational output speed to the generator 24.

Figure 3:
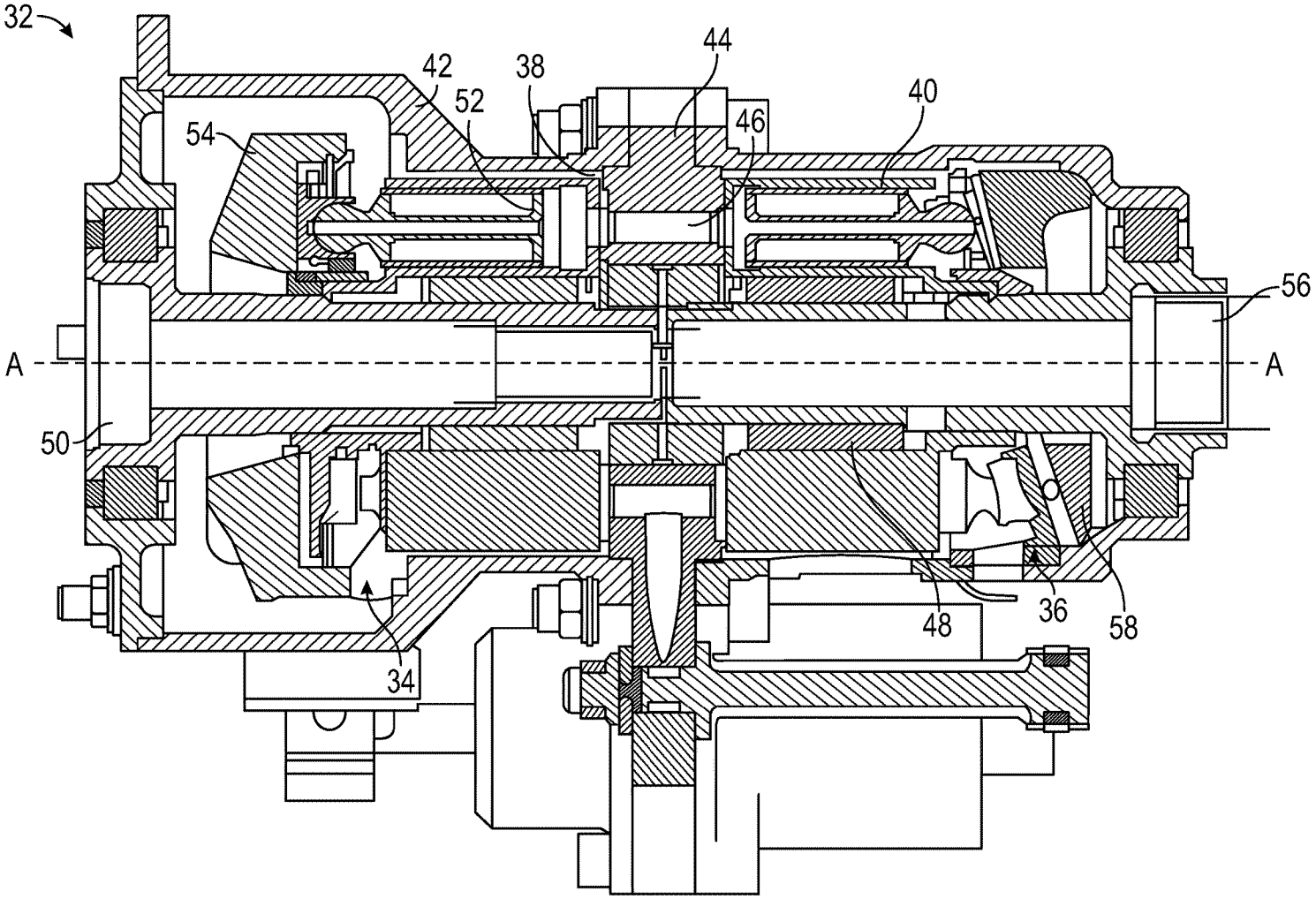
FIG. 3 is a cross-sectional view of an example of a hydraulic unit of an integrated drive generator.
Figure 4:
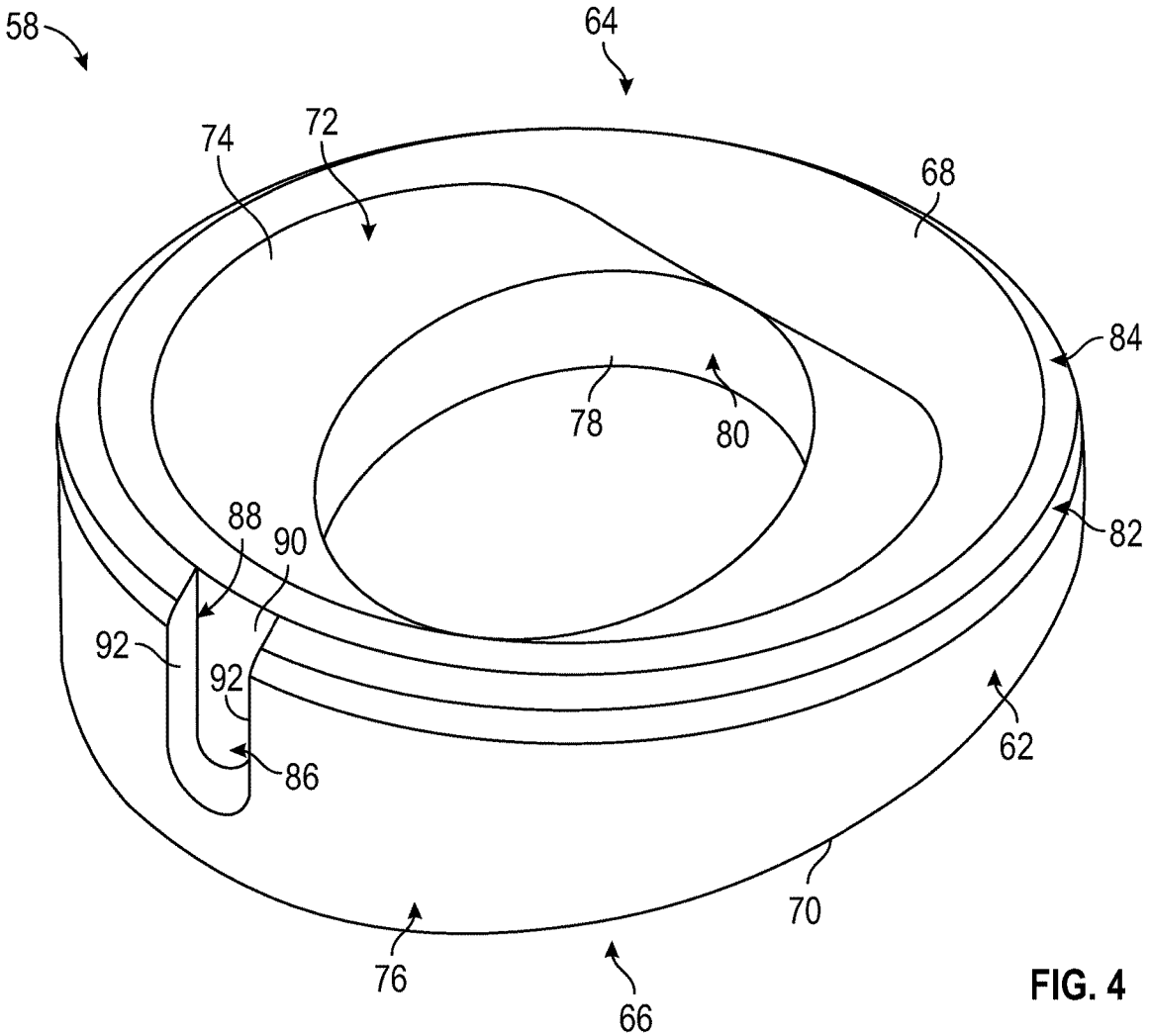
FIG. 4 is a perspective view of an example of a fixed wobbler that may be used with the hydraulic unit of FIG. 3.

Referring now to FIG. 3, an example of a hydraulic unit 32 of the IDG 16 is illustrated in more detail. The hydraulic unit 32 includes a variable displacement hydraulic pump 34 and a fixed displacement hydraulic motor 36. The pump 34 and motor 36 have respective cylinder blocks 38 and 40 which are arranged for rotation about a common axis A within a housing 42 on opposite sides of a stationary port plate 44 of the hydraulic unit 32. The port plate 44 is formed with apertures 46 through which hydraulic fluid communication between the pump 34 and the motor 36 is established during normal operation of the hydraulic unit 32. A biasing mechanism 48 resiliently biases the cylinder blocks 38, 40 in the direction of the port plate 44.

The operation of the hydraulic unit 32 in an IDG 16 of an aircraft involves transmission of torque from an engine of the airplane to an input, which rotates the input shaft 50 of the hydraulic unit 32 about axis A. The cylinder block 38 of the pump 34 is connected to the input shaft 50 for rotation therewith. Pistons 52 within the cylinder block 38 of the pump 34 are displaced during this rotation an amount which is a function of the setting of a variable wobbler 54 of the pump 34. Variable wobbler 54 sets the stroke of each piston 52 depending on its angular position around axis A and on the setting of the wobbler itself.

Hydraulic fluid under pressure from the pump 34 is delivered to the hydraulic motor 36 through the port plate 44 for rotating the cylinder block 40 and an output shaft 56 to which it is fixedly connected. A fixed wobbler 58 of the motor 36 is fixed so that the operating speed of the motor 36 is a function of the displacement of the pump 34. Fixed wobbler 58 sets the stroke of each piston 52 depending on its angular position around axis A. The rotary output from output shaft 56 is added to or subtracted from the rotary motion from the engine through the conventional differential gearing of an IDG 16 for operating an electrical generator at a substantially constant rotational speed. That is, since the speed of the rotation from the airplane engine to the input 50 of the hydraulic unit 32 will vary, the position of the variable wobbler 54 is adjusted in response to these detected speed variations for providing the necessary reduction or increase in this speed for obtaining the desired constant output speed to the generator. During normal operation, there is a hydrostatic balance of the cylinder blocks and port plate. Although the hydraulic unit illustrated and described herein refers to the variable unit as a pump and the fixed unit as a motor, hydraulic units having other configurations, such as where the variable unit functions as a motor and the hydraulic unit operates as a pump for example, are within the scope of the invention.

Referring now to FIGS. 4-7, fixed wobbler 58 of hydraulic unit 32 according to an embodiment of the invention is illustrated in more detail. Fixed wobbler 58 includes a body 62 having a first end 64 and a second, opposite end 66. First end 64 defines a first surface 68, and second end 66 defines a second surface 70 configured to contact pistons 52.

Figure 6:
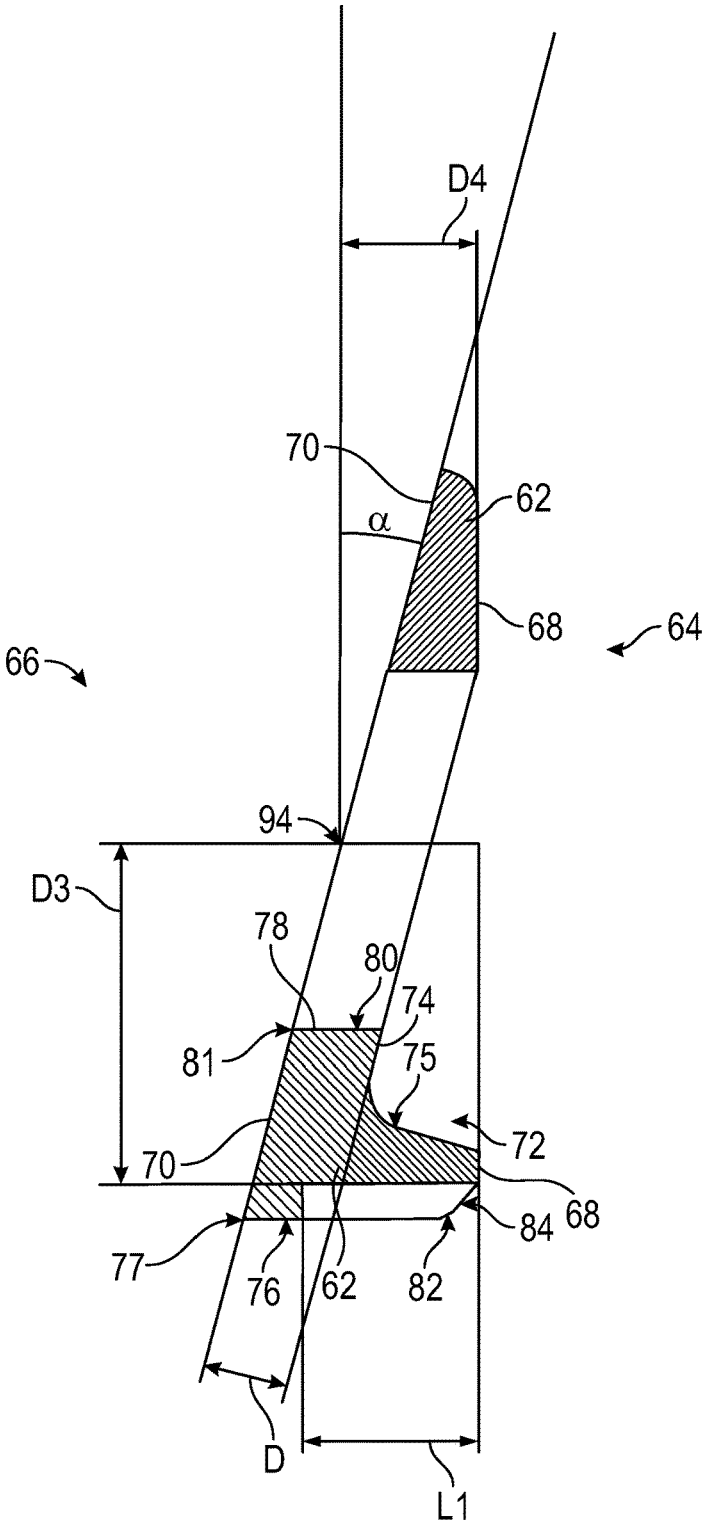
FIG. 6 is a cross-sectional view of the fixed wobbler shown in FIG. 5 and taken along line A-A.

As shown in FIG. 6, second surface 70 is oriented with respect to first surface 68 at an angle $\alpha$. In one embodiment, angle $\alpha$ is between approximately 12.75° and approximately 16.75°. In another embodiment, angle $\alpha$ is between 12.75° and 16.75°. In one embodiment, angle $\alpha$ is approximately 14.75°. In another embodiment, angle $\alpha$ is 14.75°. Second surface 70 is configured to contact and reciprocate/translate pistons 52 along an axis parallel to axis A (FIG. 3).

First end 64 may include a cutout 72 formed in first surface 68 and defining a cutout surface 74, for example, to reduce size and weight of fixed wobbler 58. Cutout surface 74 may define an inner shoulder 75 (FIG. 6). In one embodiment, inner shoulder 75 has a radius of approximately 0.156±0.015 inches (0.3962±0.1381 cm). In another embodiment, inner shoulder 75 has a radius of 0.156±0.015 inches.

First surface 68 may include a coating to reduce friction and wear between surface 70 and pistons 52. In one embodiment, the coating is titanium nitride disposed by physical vapor deposition. However, other friction-reducing coating materials (e.g., Amorphous Diamond-like Carbon Coating) may be disposed on surface 70 by other suitable methods. Further, additional portions and surfaces of fixed wobbler 58 may include the coating described herein (e.g., cutout surface 74). In one embodiment, the coating has a thickness of approximately 1-4 microns. In another embodiment, the coating has a thickness of 1-4 microns. In one embodiment, the coating has a thickness of approximately 3-5 microns. In another embodiment, the coating has a thickness of 3-5 microns.

Body 62 defines an outer diameter 76 and includes an inner wall 78 defining an inner diameter 80. In one embodiment, outer diameter 76 is approximately 2.1655+0.0000−0.0007 inches (5.5004+0.000−0.0018 cm). In another embodiment, outer diameter 76 is 2.1655 inches+0.0000−0.0007 inches. Outer diameter 76 may include a corner break 77 (FIG. 6). In one embodiment, corner break 77 is less than or equal to approximately 0.005 inches (0.0127 cm). In another embodiment, corner break 77 is less than or equal to 0.005 inches.

In one embodiment, inner diameter 80 is approximately 1.043±0.003 inches (2.6492±0.0076 cm). In another embodiment, inner diameter 80 is 1.043±0.003 inches. As illustrated in FIG. 6, inner wall 78 has a depth D. In one embodiment, depth D is approximately 0.250±0.015 inches (0.635±0.0381 cm). In another embodiment, depth D is 0.250±0.015 inches. Inner wall may include a corner break 81 (FIG. 6). In one embodiment, corner break 81 is less than or equal to approximately 0.005 inches (0.0127 cm). In another embodiment, corner break 81 is less than or equal to 0.005 inches.

Figure 7:
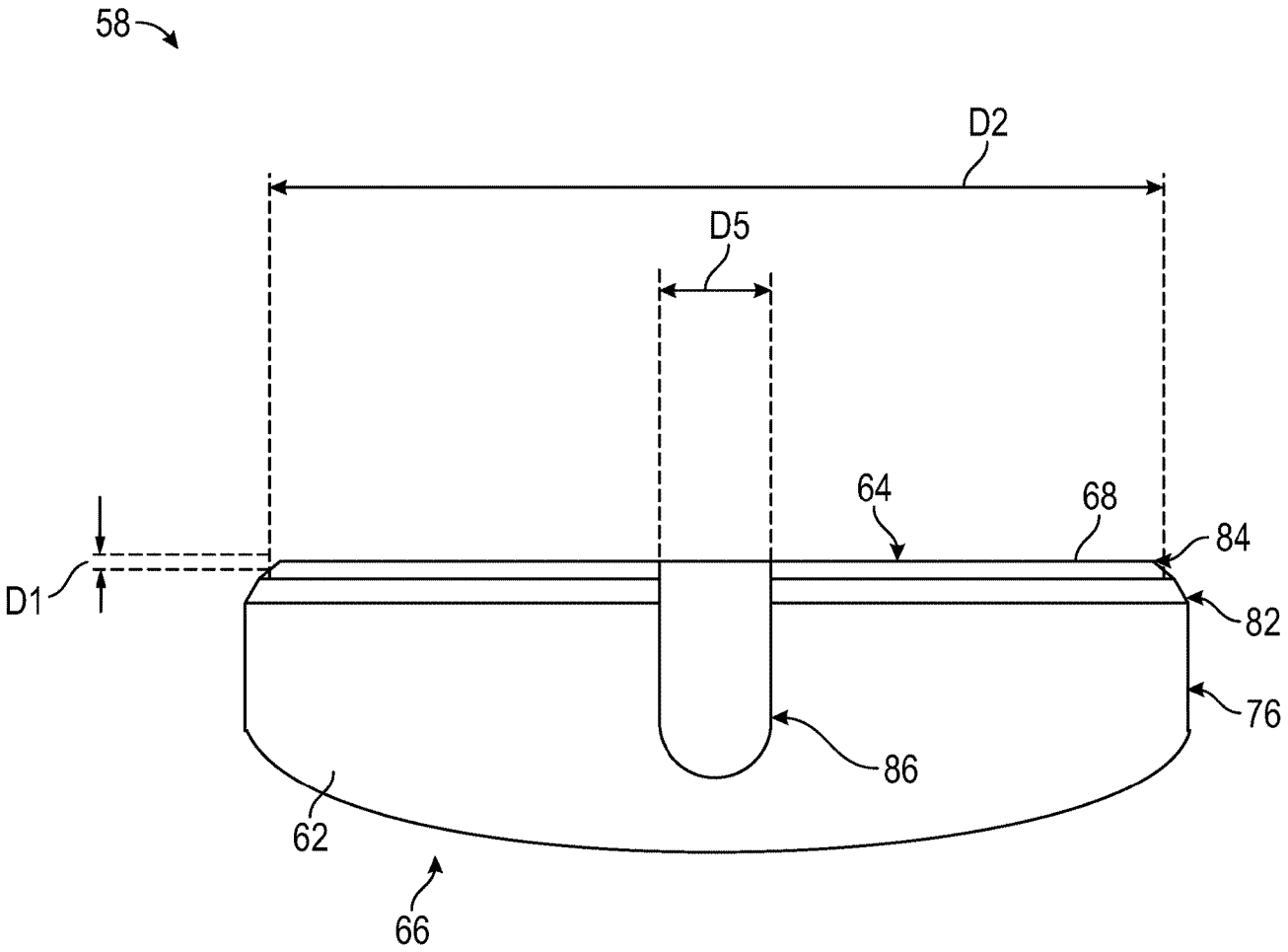
FIG. 7 is a side view of the fixed wobbler shown in FIG. 4.

With further reference to FIG. 7, first end 64 includes a first corner break 82 and a second corner break 84. In one embodiment, first corner break 82 is approximately 0.035±0.010 inches (0.0889±0.0254 cm). In another embodiment, first corner break 82 is 0.035±0.010 inches. In one embodiment, a distance D1 from a point (e.g., a midpoint) of second corner break 84 to first surface 68 is approximately 0.032±0.005 inches (0.0813±0.0127 cm). In another embodiment, distance D1 is 0.032±0.005 inches. In one embodiment, a distance D2 between diametrically disposed midpoints of second corner break 84 is approximately 2.064 inches (5.2426 cm). In another embodiment, distance D2 is 2.064 inches. In one embodiment, second corner break 84 is oriented at an angle of approximately 40°+0.00°−0.25° relative to first surface 68. In another embodiment, second corner break 84 is oriented at an angle of 40°+0.00°−0.25°.

Figure 5:
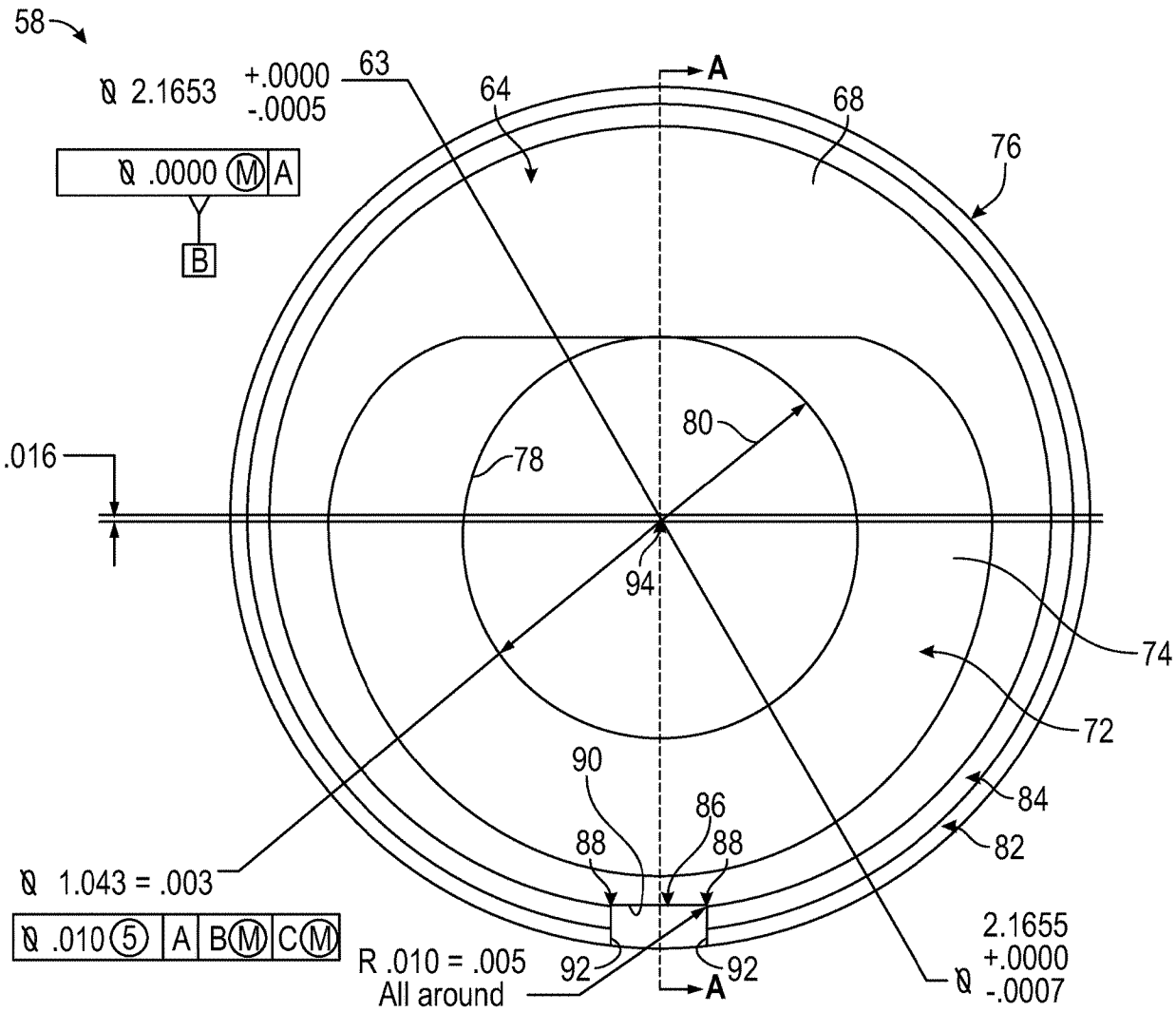
FIG. 5 is a plan view of the fixed wobbler shown in FIG. 4.

Body 62 includes a locking feature or key 86 formed in outer diameter 76. Key 86 is configured to receive a portion of housing 42 or other component (e.g., a stepped pin) to facilitate preventing rotation of fixed wobbler 58 within housing 42. Key 86 includes inner rounded corners 88, an inner rear wall 90, and side walls 92 (FIG. 5). In one embodiment, rounded corners 88 have a radius of approximately 0.010±0.005 inches (0.0254±0.0127 cm). In another embodiment, rounded corners 88 have a radius of 0.010±0.005 inches. Key 86 includes a length L1 (FIG. 6) extending along outer diameter 76. In one embodiment, L1 is approximately 0.503±0.010 inches (0.1.278±0.0254 cm). In another embodiment, L1 is 0.503±0.010 inches. Body 62 includes a distance D3 between inner rear wall 90 and a centerpoint 94 of outer diameter 76 (FIG. 6). In one embodiment, distance D3 is approximately 0.982+0.000−0.010 inches (2.4943+0.000−0.0254 cm). In another embodiment, distance D3 is 0.982+0.000−0.010 inches. Body 62 includes a distance D4 between centerpoint 94 and first surface 68 (FIG. 6). In one embodiment, distance D4 is approximately 0.392 inches (0.9957 cm). In another embodiment, distance D4 is 0.392 inches. Key 86 defines a distance D5 between side walls 92 (FIG. 7). In one embodiment, distance D5 is approximately 0.250+0.005−0.000 inches (0.635+0.0127−0.000 cm). In another embodiment, distance D5 is 0.250+0.005−0.000 inches.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A fixed wobbler of a hydraulic unit, the fixed wobbler comprising:

a body having a first end and an opposite second end, the first end defining a first surface, and the second end defining a second surface oriented at an angle relative to the first surface, the body having an outer diameter extending from the first surface to the second surface and an inner wall defining an inner diameter, the body includes a locking feature formed in the outer diameter and extends towards the inner wall, the outer diameter is 2.1655+0.0000−0.0007 inches (5.5004+0.000−0.0018 cm), and the inner diameter is 1.043±0.003 inches (2.6492±0.0076 cm), the body first end includes a first corner break disposed adjacent to a second corner break, the first corner break oriented relative to the first surface at a second angle, the second angle is 40°+0.00°−0.25°.

2. The fixed wobbler of claim 1, wherein the body further comprises a cutout formed in the first surface about at least a portion of the inner wall.

3. The fixed wobbler of claim 2, wherein the cutout defines an inner shoulder having a radius of 0.156±0.015 inches (0.3962±0.1381 cm).

4. The fixed wobbler of claim 1, wherein the angle is between 12.75° and 16.75°.

5. The fixed wobbler of claim 1, wherein the angle is 14.75°.

6. The fixed wobbler of claim 1, wherein the locking feature is defined by an inner rear wall that extends between a pair of side walls that extend between the outer diameter and the inner rear wall.

7. The fixed wobbler of claim 6, wherein the locking feature has a length of 0.503±0.010 inches (1.2777±0.0254 cm).

8. The fixed wobbler of claim 6, wherein a distance between the side walls is 0.250+0.005−0.000 inches (0.635+0.0127−0.000 cm).

9. The fixed wobbler of claim 6, wherein a distance from the inner rear wall to a centerpoint of the outer diameter is 0.982+0.000−0.010 inches (2.4943+0.000−0.0254).

10. The fixed wobbler of claim 1, wherein the second surface comprises a friction-reducing coating.

11. The fixed wobbler of claim 10, wherein a thickness of the friction-reducing coating is between 3 microns and 5 microns.

12. The fixed wobbler of claim 11, wherein the friction-reducing coating is an Amorphous Diamond-like Carbon Coating.

13. The fixed wobbler of claim 1, wherein the inner wall includes a corner break that is less than or equal to 0.005 inches (0.0127 cm).

14. The fixed wobbler of claim 1, wherein a portion of the first surface opposite the locking feature becomes progressively closer to the second surface in a direction that extends from the inner diameter towards the outer diameter.

* * * * *